United States Patent [19]

Dunchock

[11] 4,084,700

[45] * Apr. 18, 1978

[54] DISPLAY RACK

[75] Inventor: Richard S. Dunchock, Farmington Hills, Mich.

[73] Assignee: Optarac Corporation, Hollywood, Fla.

[ * ] Notice: The portion of the term of this patent subsequent to Dec. 9, 1992, has been disclaimed.

[21] Appl. No.: 655,747

[22] Filed: Feb. 6, 1976

[51] Int. Cl.[2] ..... A47F 7/02; A47F 7/14

[52] U.S. Cl. ..... 211/41; 248/126; 248/470; 248/DIG. 2

[58] Field of Search ..... 248/454, 459, 469, 470, 248/471, 472, 473, 474, 126, DIG. 2, 121, 124, 125; 211/13, 57, 41, 59, 87; 206/5, 6; D6/157, 114, 122; D57/1 C; 40/10 R, 158 B

[56] References Cited

U.S. PATENT DOCUMENTS

| | | | |
|---|---|---|---|
| 759,040 | 5/1904 | Stahl | 248/488 |
| 993,674 | 5/1911 | Freeman | 40/16.4 |
| 1,247,033 | 11/1917 | Swartz | 248/459 |
| 1,529,347 | 3/1925 | Dawson | 248/DIG. 2 X |
| 1,665,271 | 4/1928 | Lubbers | 248/459 |
| 1,842,118 | 1/1932 | Resnik et al. | 211/41 |
| 2,642,190 | 6/1953 | Kelly | 248/126 |
| 2,969,605 | 1/1961 | Garvin | 40/10 R |
| 3,184,058 | 5/1965 | Crowther | 248/DIG. 2 X |
| 3,351,208 | 11/1967 | Siegel | 211/13 |
| 3,431,667 | 3/1969 | Woods | 40/158 B |
| 3,473,671 | 10/1969 | Gangitano | 211/87 X |
| 3,608,220 | 9/1971 | Fryrear | 40/10 R X |
| 3,858,726 | 1/1975 | Rosenwein | 211/13 |
| 3,924,750 | 12/1975 | Dunchock | 211/13 |

FOREIGN PATENT DOCUMENTS

| | | | |
|---|---|---|---|
| 31,014 | 12/1907 | Germany | 248/454 |
| 669,604 | 4/1952 | United Kingdom | 211/41 |

*Primary Examiner*—Roy D. Frazier
*Assistant Examiner*—Thomas J. Holko
*Attorney, Agent, or Firm*—Basile & Weintraub

[57] ABSTRACT

A display rack for mounting eyeglass lenses, mirrors, and like articles. The display rack has a body panel with integrally formed top and base flanges which, respectively, are adapted to releasably attach the body panel to an upright wall or support the body panel in an upright position on a horizontal surface. In one embodiment of the present invention the body panel is provided with a plurality of arcuately spaced support tabs which are adapted to releasably support a plurality of eyeglass lenses. In a second embodiment of the invention a plurality of vertically spaced and laterally opposed support tabs are provided for slidably receiving an element to be carried by the display rack such as a mirror or a removable support panel on which a plurality of articles are to be displayed.

6 Claims, 7 Drawing Figures

FIG-

DISPLAY RACK

CROSS-REFERENCE TO RELATED APPLICATIONS

The present invention is related in substance to U.S. patent application Ser. No. 501,178 filed Aug. 28, 1974, and now U.S. Pat. No. 3,924,750 issued Dec. 9, 1975, and U.S. design patent application Ser. No. 498,542 filed Aug. 19, 1974, for "EYEGLASS DISPLAY UNIT."

BACKGROUND OF THE INVENTION

I. Field of the Invention

The present invention relates to a new and useful improvement in display stands, racks, and units and, more particularly, to a display rack which may be selectively mounted to a vertical wall or disposed in an upright position on a horizontal surface for the purpose of displaying articles of manufacture.

II. Description of the Prior Art

Heretofore numerous devices and apparatus have been employed to display various elements including the display of eyeglass lenses.

While these display racks and units have provided various means for displaying eyeglasses and related paraphernalia, none of the display racks provide a simple, attractive, and inexpensive unit which may be used to display eyeglass lenses, mirrors, and other articles as desired wherein the display unit may be selectively mounted to a vertical wall or disposed in an upright position on a horizontal support.

SUMMARY OF THE INVENTION

The present invention, which will be described subsequently in greater detail, comprises a display rack having a body panel on which are mounted means for carrying a plurality of articles of manufacture, such as eyeglass lenses. The display rack has means providing for the sliding engagement of a removable support panel on which are mounted articles of manufacture. Alternately, the display rack mounts a removable mirror. The body panel is provided with means which permit the simple mounting of the display rack on a vertical wall or for support in an upright position on a horizontal surface.

It is therefore an object of the present invention to provide a new and improved display rack for the mounting and display of articles of manufacture.

It is a further object of the present invention to provide a display rack for the mounting of eyeglass lenses wherein the eyeglass lenses are securely attached to the display rack but may be simply removed and replaced, as desired.

It is a further object of the present invention to provide a display rack wherein a mirror may be simply and inexpensively attached to the face of the display rack.

It is still an object of the present invention to provide a display rack for the mounting of a removably attachable support panel on which is mounted a plurality of articles of manufacture displayed for sale.

It is still a further object of the present invention to provide a display rack having all the aforementioned advantages, yet one which is extremely simple in its design and configuration and, thus, economical to manufacture and ultimately one which is highly marketable within its selected field.

Other objects, advantages, and applications of the present invention will become apparent to those skilled in the art of display racks and the like when the accompanying description of the best modes contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and in which:

FIG. 5 is a partially exploded perspective view of a second embodiment of a display rack illustrated in position to be mounted to a vertical wall;

DESCRIPTION OF THE PREFERRED EMBODIMENTS

Figures 1, 2, 3, 4, 6, 7:
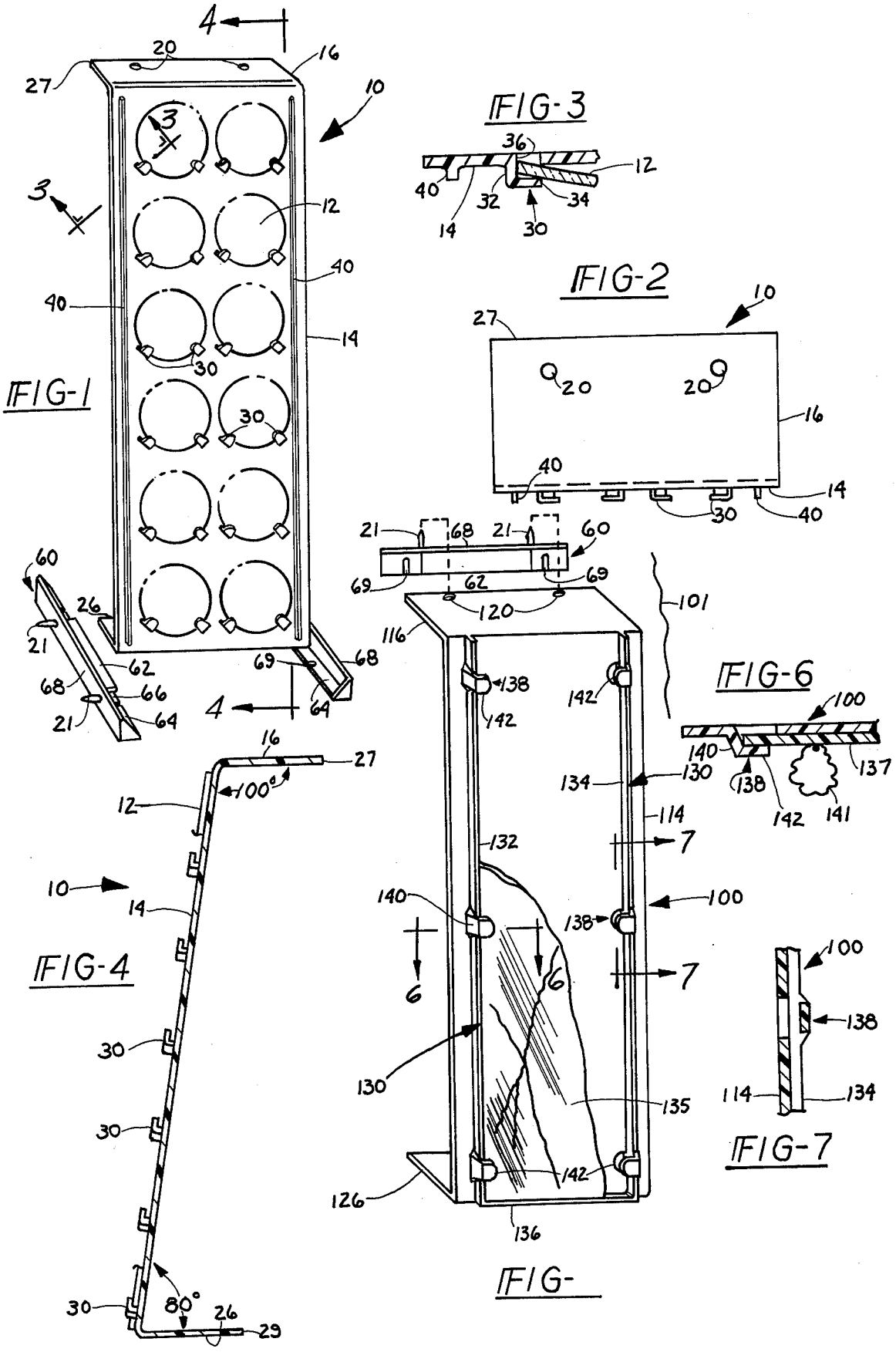
FIG. 1 is a perspective view of an eyeglass lens display rack illustrated in an upright position supported on a horizontal surface.
FIG. 2 is a top plan view of the display rack illustrated in FIG. 1.
FIG. 3 is a fragmentary, enlarged sectional view of the display rack taken along Line 3—3 of FIG. 1.
FIG. 4 is a longitudinal sectional view of the display rack taken along Line 4—4 of FIG. 1.
FIG. 6 is an enlarged, fragmentary sectional view of the display rack taken along Line 6—6 of FIG. 5.
FIG. 7 is an enlarged, fragmentary sectional view of the display rack taken along Line 7—7 of FIG. 5.

Referring now to the drawing and, in particular, to FIGS. 1–4 wherein there is illustrated one example of the present invention in the form of a display rack 10 which is utilized to support a plurality of eyeglass lenses 12 to facilitate the marketing of the eyeglass lenses 12. It should be understood that the term "eyeglass lenses" refers to the numerous types of eyeglass lenses that are commercially available, such as prescription eyeglass lenses and sunglass lenses, as well as non-prescription sunglass lenses as the case may be. The display rack 10 comprises a rectangularly shaped front or body panel 14 having an integrally formed top flange 16 that is disposed in a plane that is inclined approximately 100° (FIG. 4) with respect to the plane of the front body panel 14. The extending end portion of the top flange 16 has a pair of laterally spaced hanging apertures 20 through which suitable attaching prongs 21, as will be described hereinafter, extend for the purpose of facilitating the removable mounting of the display unit 10 to a vertical wall in a manner which will also be described in greater detail hereinafter.

The lower portion of the body panel 14 has a rearwardly projecting, integrally formed base flange 26. The base flange 26 is parallel to the top flange 16 and is also inclined with respect to the plane within which the body panel 14 is disposed such that the angle of inclination (FIG. 4) between the body panel 14 and the base flange 26 is preferably 80°. The distance from the outer face of the body panel to the rearwardly facing edge 27 of the top flange 16 is equal to the distance from the outer face of the body panel 14 to the rewardly facing outer edge 29 of the base flange 26. Thus, when the display unit 10 is mounted to a vertical wall such as when the support prongs 21 extend through the apertures 20, as will be described hereinafter, the rearwardly facing edges 29 and 27, respectively, of base flange 26 and top flange 16 will both rest against the vertical wall. Since the rearwardly facing edges of the top flange 16 and the base flange 26 are of an equal distance from the outer face of the body panel 14, the rectangularly shaped body panel 14 will be disposed in a substantially vertical plane.

It is intended that the display rack 10 be mounted to a vertical wall; and a potential customer, upon viewing the articles carried on the display rack 10, may remove such display rack 10 and mount the same on a table or other horizontal surface simply by resting the display rack 10 on its base flange 26, as illustrated in FIG. 4, whereupon individual lenses may be simply and easily removed from the display unit 10 for close inspection by the customer.

To this end, the display unit 10 is provided with a pair of L-shaped supports 60, each of which has an intermediate portion 62, which in conjunction with the base section 64 of the support 60 defines a slot 66. The slot 66 snugly receives the outer side edges of the base flange 26, as such shown in FIG. 1, while the opposite ends of each support 60 extend forwardly and rearwardly of the base flange 26 to aid in supporting the display unit 10 in an upright position when it is desired to maintain the display rack 10 in the upright position for long periods of time as opposed to its intermediate removal from a vertical wall surface for temporary positioning in an upright position. It should be noted that the other leg 68 mounts the two projecting prongs 21, while the base section leg 64 is provided with a pair of laterally spaced slots 69, the purpose of which will be described hereinafter.

As can best be seen in FIG. 1, the rectangularly shaped body panel 14 is provided with a series of vertically spaced and horizontally opposed pairs of support tabs 30, each pair of support tabs 30 being adapted to releasably support an eyeglass lens 12 in the manner illustrated in FIGS. 1 and 3. While only one pair of support tabs 30 will be described in detail, it should be understood that the description herein refers equally to all of the support tabs 30 illustrated on the display rack 10. Each support tab 30 is an integral L-shaped projection having a leg 32 attached to the face of the body 14 and a leg 34 which extends above a slot 36 formed in the face of the body panel 14 and which permits the integral molding of the legs 32 and 34. Each set of support tabs 30 is arcuately spaced from each other and disposed along intersecting axes to receive the curved eyeglass lens 12 with sufficient snugness as to insure the safe and secure mounting of the lens 12 between the support tabs 30 and the face of the body panel 14. This is accomplished due to the curvature of the lens 12 exerting a slight outward pressure against the leg 34 of the tabs 30 whereby the lens 12 is securely attached to the face of the body panel 14. This arrangement of two support tabs for the mounting of a single eyeglass lens lends itself favorably to the simple and secure mounting of a plurality of eyeglass lenses 12 to the face of the body panel 14 and permits the display rack 10 to be positioned in a vertical wall in the manner aforementioned and removed therefrom and positioned on a horizontal surface without concern for the eyeglass lenses 12 falling from their supporting engagement with the sets of support tabs 30.

As can be seen in FIGS. 1, 2, and 3, a pair of laterally spaced and vertically disposed ribs 40 are provided on opposite sides of the front face of the body panel 14. The ribs 40 are integral projections on the front surface of the body panel 14 and provide a decorative feature to enhance the appearance of the display rack 10.

Referring now to FIGS. 5–7 wherein there is illustrated a second example of the present invention in the form of a display rack 100 which is used in a manner similar to the display rack 10 in that it may support one or more items on a vertical wall 101 or selectively on a horizontal surface. The display rack 100 comprises a rectangularly shaped body panel 114 having an integrally formed top flange 116 that is disposed in a plane that is inclined approximately 100° with respect to the plane of the body panel 114. The extending end of the top flange 116 has a pair of laterally spaced hanging apertures 120 through which the aforementioned hanging prongs 21 extend for the purpose of facilitating the removable mounting of the display unit 100 to the vertical wall 101. To this end, one of the L-shaped supports 60 is first attached to the wall by means of inserting a conventional threaded fastener (not shown) through the slot 69 and engaging the wall securely. The support 60 is fastened to the vertical wall such that the hanging prongs 21 are disposed in the vertical positions illustrated in FIG. 6. It can thus be seen that simply by positioning the top flange 116 above the projecting prongs 21 and aligning the hanging apertures 120 therewith, the prongs 21 may be received within the hanging apertures 120 and the display rack 100 is securely and releasably attached to the vertical wall 101. In the same manner the display rack 10, hereinbefore described, may be similarly attached to a vertical wall; that is, by inserting the hanging prongs 21 through the hanging apertures 20 of the rack 10.

The lower portion of the body panel 114 has a rearwardly projecting, integrally formed base flange 126 which is parallel to the top flange 116 and is also inclined with respect to the plane within which the body panel 114 is disposed. Preferably, the angle of inclination between the body panel 114 and the base flange 126 is 80°. In a manner similar to the display rack 10 hereinbefore described, the distance from the outer face of the body panel 114 to the rearwardly facing edge of the top flange 116 is equal to the distance from the outer face of the body panel 114 to the outer edge of the base flange 126. Thus, when the display rack 100 is mounted to the vertical wall 101, the rearwardly facing edge of the top flange 116 rests against the vertical wall, while at the same time the longitudinal edge of the base flange 126 rests against the vertical wall. In this position the rectangularly shaped body panel 114 will be disposed in a vertical plane in the same manner as display rack 10 described hereinbefore.

The face of the body panel 114 has an integrally formed U-shaped framing member 130, the upright legs 132 and 134 of which are horizontally spaced from each other in close proximity to the outer side edges of the body panel 114. The legs 132 and 134 of the framing member 130 extend the full length of the body panel 114 and are integrally joined to the base section 136 of the framing member 130. A plurality of integrally formed support tabs 138 are located along each leg of the framing member 130. The support tabs 138 disposed on the legs 132 and 134 are located, preferably, in opposing relationship to each other to provide not only for the secure attachment of articles, as will be described hereinafter, but to provide for the enhancing of the overall appearance of the display rack 100. The support tabs 138 are L-shaped projections in the form of a projecting leg 140 extending from and integrally formed with the body panel 114, while the other leg 142 of each projecting tab 138 extends inwardly toward the center of the body panel 114 and functions to provide a snug fit for a panel member that is inserted lengthwise from the top of the body panel 114 behind each leg 142 of each support tab 138 and between the legs of the framing member 130 until the bottom edge of the panel abuts the top surface of the base section 136. In this position the panel member is securely attached to the display rack 100. The panel member in question should have a thickness approximately equal to the depth of the framing member 130, a width equal to the distance between the legs 132 and 134 of the framing member, and a length which is substantially equal to the length of the body panel 114.

In the embodiment illustrated in FIG. 5, the panel member is in the form of a mirror 135 which has been inserted into a supporting relationship with the framing member 130 and the tabs 138 whereby the display rack 100 may be positioned on a vertical wall for easy use by a customer to view himself. Alternately, the rack 100 may be simply removed from the wall and mounted on a horizontal surface, such that the person may view himself while seated.

As can best be seen in FIG. 6, in lieu of the mirror the framing member 130 may be utilized to slidably receive and support a panel member 137 on which are mounted a plurality of items 141 that are being offered for sale. It can thus be seen that the display rack 100 may be utilized for displaying numerous articles which are desired to be sold simply by providing various interchangeable panel members 137 on which are mounted any desired article.

Thus, the display rack 100 may mount a mirror which may be used in conjunction with the display rack 10 illustrated in FIG. 1 and/or the display rack described in the aforementioned U.S. Pat. No. 3,924,750 to provide a visual aid in the sale of eyeglasses and eyeglass lenses permitting a simple and easy viewing of one's self in an attractive setting. Additionally, the display rack 100 may be utilized for displaying numerous types of articles by means of interchangeable panel members 137 on which the item to be sold is secured.

It can thus be seen that the present invention provides a new and improved display rack which is extremely simple in construction and which may be easily and simply mounted to a vertical wall or placed in an upright position on a horizontal support.

While only two forms of the present invention have been disclosed, it should be apparent to those skilled in the art of display racks that other forms of the invention may be had, all coming within the spirit of the invention and the scope of the appended claims.

What is claimed is as follows:

1. A display rack comprising:

a flat body panel fabricated from a plastic material, said body panel having means associated with the upper edge of said body panel for mounting said body panel to a vertical wall and maintaining said body panel in a substantially vertical plane;

means associated with the lower edge of said body panel for supporting said body panel in an inclined plane when said last mentioned means is positioned on a horizontal surface;

a planer member releasably carried on the front face of said body panel;

a framing member of a generally U-shaped configuration integral with the front face of said body panel, said framing member having a base portion disposed along said panel lower edge with the opposite ends of said base portion terminating at locations inwardly spaced from the side edges of said body panel, said framing member having a pair of upright leg portions, the upper ends of said leg portions terminating at said upper edge of said panel to define an opening thereinbetween, said leg portions being inwardly spaced from and in close proximity to the side edges of said panel, said base and leg portions providing a lateral abutment for said planer member to prevent movement of said planer member across the face of said body panel and not restraining said planer member from outward movement, each of said framing member leg portions further comprising a plurality of integrally formed and vertically spaced support tabs, each tab being of an L-shaped configuration and having one arm projecting towards the other leg portion to define an abutment means for maintaining said planer member against the front face of said body panel, said support tab one arm being spaced from said body panel surface a sufficient distance to provide a snug fit for said planer member when the same is inserted through the opening defined at the upper edge of said body panel and behind said support tabs to securely and releasably attach said planer member to said display rack, said body panel having an aperture formed therein behind each of said tabs, said aperture having a shape which is complementary to its associated projecting arm.

2. The display rack defined in claim 1 wherein said panel member is a mirror.

3. The display rack defined in claim 1 wherein said means associated with said upper edge of said body panel comprises a top flange extending behind said body panel, said flange having an aperture at its outer edge for mounting said body panel to said vertical wall; said means associated with said lower edge of said body panel comprising a base flange for supporting said body panel in said inclined position;

a display rack support having an L-shaped configuration in the form of two angularly disposed support members, a flange member extending from one of said support members and parallel to the other of said support members defining with said other support member a slot snugly receiving the outer edge of said base flange for supporting said rack in said inclined position; and means for selectively attaching said rack support to said vertical wall, said one support member of said rack support having an upright prong adapted to engage said top flange aperture and support said display rack in said vertical plane.

4. A display rack comprising:

a flat body panel fabricated from a plastic material, said body panel having means associated with the upper edge of said body panel for mounting said body panel to a vertical wall and maintaining said body panel in a substantially vertical plane;

means associated with the lower edge of said body panel for supporting said body panel in an inclined plane when said last mentioned means is positioned on a horizontal surface;

a plurality of support means on the face of said body panel for supporting eyeglass lens, each support means comprising two support tabs disposed in an arcuately spaced relationship with respect to each other, each tab having an L-shaped configuration with one leg extending outwardly from said body panel and integral therewith and a second leg extending laterally from said first leg toward the other of said support tabs, the distance between said panel and the inside surface of said second leg being such as to snugly receive and releasably support said eyeglass lens.

5. The display rack defined in claim 4 wherein said body panel has an aperture formed therein behind each of said second legs, said aperture having a shape which is complementary to its associated second leg.

6. The display rack defined in claim 4 wherein said means associated with said upper edge of said body panel comprises a top flange extending behind said body panel, said flange having an aperture at its outer edge for mounting said body panel to said vertical wall; said means associated with said lower edge of said body panel comprising a base flange for supporting said body panel in said inclined position;

a display rack support having an L-shaped configuration in the form of two angularly disposed support members, a flange member extending from one of said support members and parallel to the other of said support members defining with said other support member a slot snugly receiving the outer edge of said base flange for supporting said rack in said inclined position; and means for selectively attaching said rack support to said vertical wall, said one support member of said rack support having an upright prong adapted to engage said top flange aperture and support said display rack in said vertical plane.

* * * * *